US005692618A

United States Patent [19]

Beak

[11] Patent Number: 5,692,618

[45] Date of Patent: Dec. 2, 1997

[54] ELECTRONIC PRODUCTS PACKING BOX

[75] Inventor: Soon-ki Beak, Kyungki-do, Rep. of Korea

[73] Assignee: Samsung Electronics Co., Ltd., Rep. of Korea

[21] Appl. No.: 676,966

[22] Filed: Jul. 8, 1996

[30] Foreign Application Priority Data

Jul. 7, 1995 [KR] Rep. of Korea ..... 95-19927

[51] Int. Cl.[6] ..... B65D 81/02

[52] U.S. Cl. ..... 206/586; 206/523; 206/592; 206/320

[58] Field of Search ..... 206/320, 521, 206/586, 587, 588, 591, 592, 523

[56] References Cited

U.S. PATENT DOCUMENTS

| | | | |
|---|---|---|---|
| 3,356,209 | 12/1967 | Pezely, Jr. | 206/586 |
| 4,201,293 | 5/1980 | Rigazio et al. | 206/523 |
| 4,211,356 | 7/1980 | Tsuchiya | 206/592 |
| 4,287,265 | 9/1981 | McKnight | 206/586 |
| 5,181,611 | 1/1993 | Liebel | 206/586 |
| 5,518,118 | 5/1996 | Putz et al. | 206/586 |
| 5,522,539 | 6/1996 | Bazany | 206/523 |

*Primary Examiner*—Paul T. Sewell
*Assistant Examiner*—Nhan T. Lam
*Attorney, Agent, or Firm*—Banner & Witcoff, Ltd.

[57] ABSTRACT

A box-like packaging means made of uniform material such as paperboard or clipboard having a chamber or hollow defined by four side walls, each having a pair of lids at its top and bottom edges, are disclosed, wherein a plurality of buffers are matingly engaged with cutouts formed on opposite lids in opposed side walls are provided to support respective corresponding corners of a package which being typically an electronic or electrical products. In the disclosure, a plurality of cutouts in substantially same dimension and configuration of "L"-shape are provided in opposite lids of a pair of opposed side walls. Also provided are a plurality of buffers that are substantially same configuration as cutouts, providing firm engagement with cutouts thereby endowing a stabilized encasing to a pack. As a result, package means disclosed renders buffer to shrink, saving substantial quantity of raw materials, reducing unit coast, enabling storage in a limited space, allowing package automation, thereby enhancing productivity, at a low cost.

2 Claims, 4 Drawing Sheets

ELECTRONIC PRODUCTS PACKING BOX

CROSS-REFERENCE TO RELATED APPLICATIONS

This application makes reference to, incorporates the same herein, and claims all benefits accruing under 35 U.S.C. 119 from an application for MONITOR PACKING CONTAINER earlier filed in the Korean Industrial Property Office on Jul. 7, 1995 and there duly assigned Ser. No. 95-19927 by that Office.

BACKGROUND OF THE INVENTION

1. Technical Field

The present invention relates in general to a packing box for encasing an electronic and electric products, particularly suited to enclose a video monitor, and more particularly, to an electronic products packing box having buffers fixedly provided on the lids of the body of a box-like package or container that support respective distal corners of an electric article of merchandise during packaging thereof, with the capability of saving a substantial quantity of raw material equivalent to the mass of the reduced body of buffers, reducing the space for load and unit cost, and enhancing package automation and producibility.

2. Background Art

When delivering electronic and electrical products from a warehouse, a packaging means made of uniform material such as paperboard or cardboard which is formed as open-topped box-like structure with cover lids is typically used so as to prevent products from a damage or a grave risk of injury. A pair of buffers are inserted and interposed between both sides of an electronic and electrical product and adjacent opposed side walls to provide protection against damage caused by an impact incident to conveyance and handling during delivery.

Conventionally adopted packaging means for encasing an electronic product such as a video monitor provides protection against damage from all directions by accommodating and positioning a pair of buffers to be interposed between both sides of a video monitor and adjacent opposed side walls thereof. On the occasion of the box-like package of one conventional type, opposed portion of buffers are configured to substantially engrave respective sides of a video monitor so as to fittingly mate each other. When a video monitor is packaged into a hollow defined by four side walls of the box-like package, a pair of buffers are inserted downwardly from the top opening and fast adhered to each of opposed side walls. A pair of mat are inserted and interposed between another opposed side walls and top and bottom portion of a video monitor, respectively, as to the degree necessary and a plurality of lids of the box-like package are overlapped to cover the pack.

It is noticed however that the box-like package of one conventional type widely known in the art, among others, requiring separate assembly components, has conduced to such problems as can be summarized below.

Firstly, the size of a buffer should be as large dimension as enough to provide protections on an article from damages caused by an extraneous impact from any of directions, requiring a substantial quantity of raw material, thereby rising unit cost. Secondly, a pair of buffers are prearranged to press fit into exterior surfaces of both sides of an article, respectively, during packaging, such that package automation is hampered. Thirdly, enlarged dimension of the buffer of such above type occupies much space, requiring inevitable loading space in a warehouse, thereby rising overhead shipping expenses Additionally, such buffers of a bulky nature, and of a conveyo-concave structural properties, caused the inconvenience experienced by the assembly line workers which adversely affect productivity and also created a risk of danger of falling down an article to ground by inadvertent handling during unwrapping thereby causing a product reliability issues.

SUMMARY OF THE INVENTION

Therefore, it is an object of the present invention to provide an improved structure of a packing box for encasing an electronic product which is provided with a plurality of buffers fixedly installed at opposite sides of both upper and lower lids of opposed side walls so that each buffer supports respective four corners of lower portion and upper portion of the electronic product when packed.

It is another object to provide a packing box with the capability of buffing an extraneous impact with reduced quantity of raw material for a buffer.

It is still another object to provide a packing box that lessens loading volume thereof and occupies less space in a warehouse.

It is yet still another object to provide a packing box with the capability of facilitating package automation, and of enhancing productivity.

These and other objects may be accomplished with a packing box having a plurality of buffers press-fittingly installed at the respective corners of lids of both top and bottom walls, when closed, for supporting respective corresponding edge of an article of merchandise. A pair of lids integrally formed at respective top and bottom edge of opposed side walls are perforated to accommodate passage of a buffer in "L" shape and in dimension of the same as corresponding corner portion of the article so that "L"-shaped buffers can be press-fittingly inserted and fastened to corresponding one of cutouts on the lids. The cutouts accommodating fixed engagement with and securing tight contact with buffers, are substantially of same dimension such that a portion of buffers of same cubic volume are guided and positioned to fit therein without deviation.

Cutouts formed in a pair of bottom lids are configured to support front portion of an article, say a video monitor, such that both the lower and bottom. inside portions of each of four corners of box-type package are in matingly contact with respective corresponding side and bottom walls of buffers. To this end , cutouts are arranged to be formed adjacent to side walls at right angle but spaced apart from each of four corners to fit snugly into corresponding corners. A pair of cutouts formed in opposed lids integrally formed at the top edges of opposed sidewalls, for accommodating buffers collectively support the rear portion of the article, are provided with a support rod bending at substantially right angle so as to back the outer sidewalls of a buffer and a flap extended perpendicularly away from, and as an integral part of, the support rod to retain at the right angle. Additionally, buffers are provided with a reinforcing rib formed on inner side walls which supports a corner of an article, say a video monitor, and simultaneously prevents buffer from breaking away outwardly.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
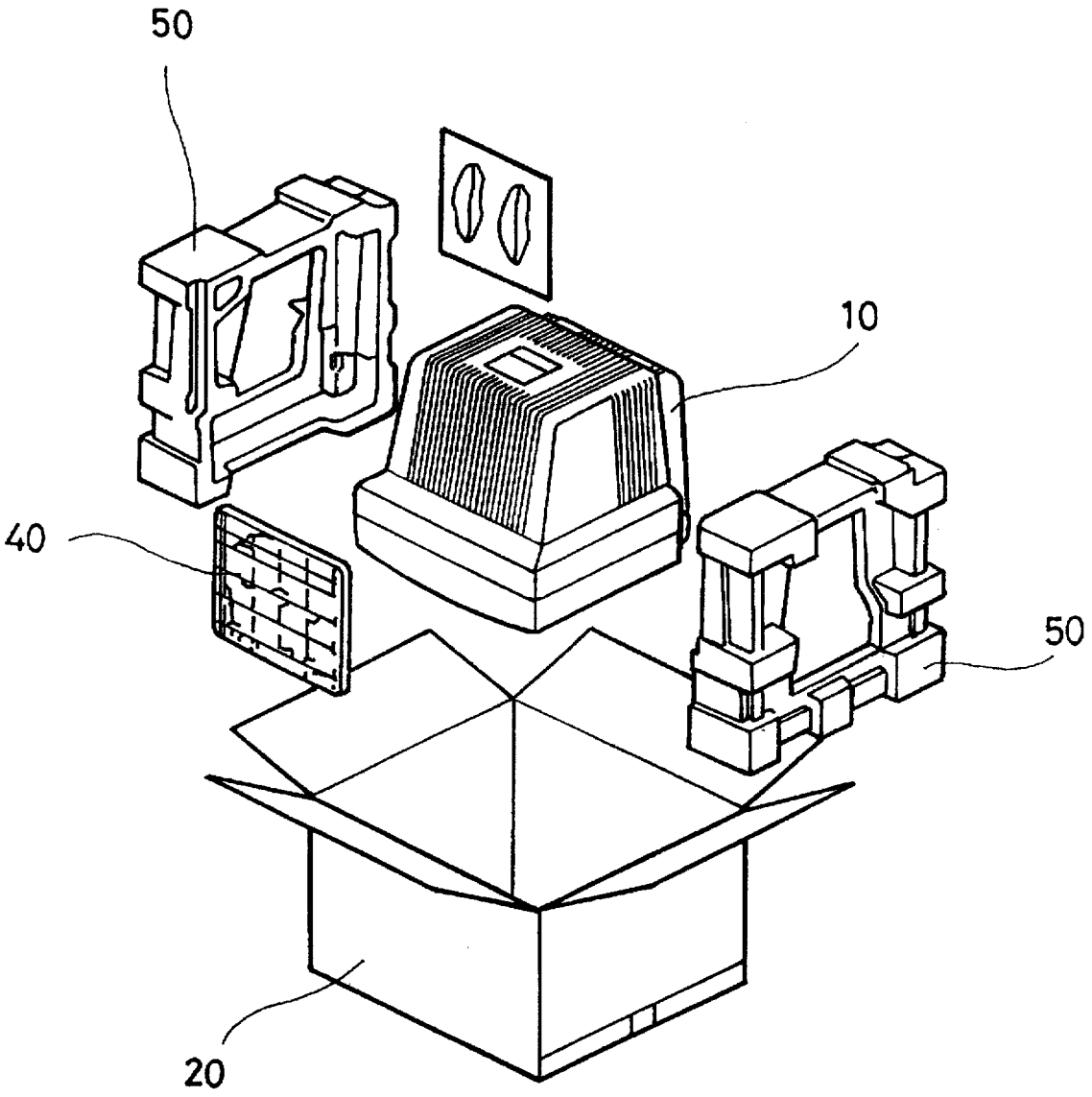
FIG. 1 is an exploded perspective view of a representation of a hypothetical typical packaging box, providing a composite illustration of conventional electronic product packaging box often used in conjunction with a video monitor.
Figure 2:
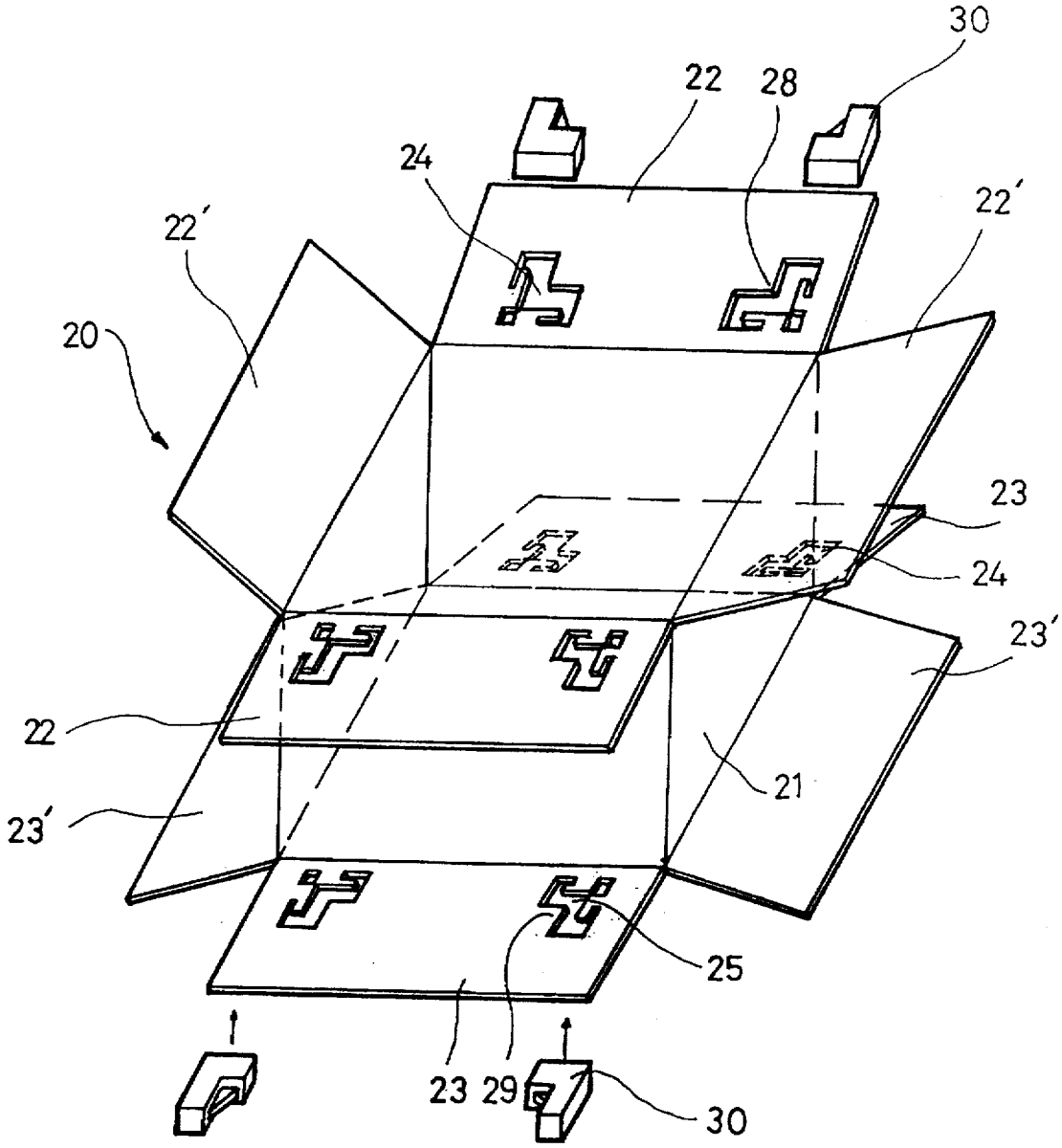
FIG. 2 is an exploded perspective view of a packaging box of one preferred embodiment constructed according to the principles of the present invention.
Figure 3:
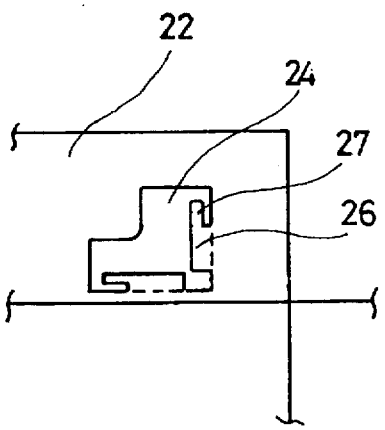
FIG. 3 is a plain view of a cutout, partially taken from a lid forming the top wall of a packaging box represented in FIG. 2.
Figure 4:
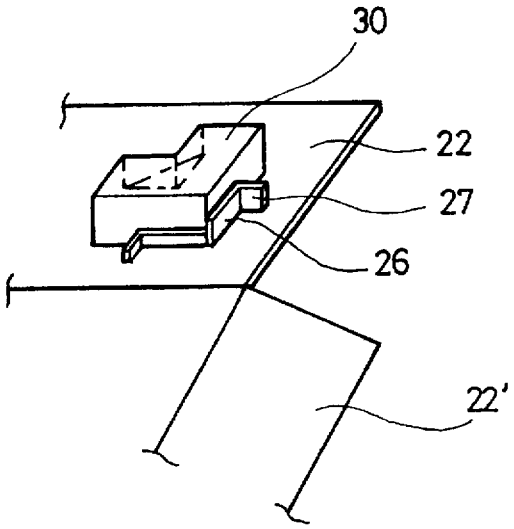
FIG. 4 is a perspective view of buffer assembled with a cutout form in a lid forming the top wall of a packaging box of one preferred embodiment constructed according to the principle of the present invention.

Turning now to the drawings, FIG. 1 illustrates hypothetical representation of typical conventionally adopted technique for buffing an electronic and electrical article of merchandise, say a video monitor for explanation purpose only, in a box-like container. A pair of buffers 50, resembling conveyo-concave surface of each side walls of the video monitor in opposed side walls, are fittingly assembled with the monitor 10 to provide protection against extraneous impact applied from any directions. When encasing, the video monitor 10 assembled with buffers are inserted into a hollow defined by four side walls of the body 20 of box-type container so as to provide a close adhesion in-between video monitor 10. interposed buffer to and adjacent side wall of the body 20. In this technique, an encased article (i.e. , a video monitor) are protected from an extraneous impact by a pair of buffers, each extending around and embracing the exterior peripheral surface of side portions. Turning now to FIG. 2 through 7 collectively, an electronic product packaging box is illustrated with a method for packing a video monitor as an exemplar. Buffer 30 is press-fittingly inserted into and fits within respective cutouts formed on each of lids 22 and 23 as integral parts of the body 20 of packaging box so as to support each corner of an article 10. Fastening means for buffer 30 and the body 20 of packaging box of one embodiment according to the present invention comprises a plurality of cutouts 24 and 25 formed at each of lids of both top and bottom ends of opposed side walls of the body 20, in substantially L-shape and equal dimension to each other, such that each hollow defined by inner side walls of respective buffer can accommodate corresponding corner of article 10, and corresponding buffers 30, in L-shape as same as cutout, that are press-fittingly inserted into and are matingly engaged with respective corresponding cutouts thereby securing tight contact therebetween.

A plurality of cutouts 25 formed on each lids of both bottom ends of opposed side walls of the body 20 that are perforated to accommodate buffers for supporting the front portion of article 10, are so arranged adjacent to a pair of side walls perpendicularly connected that buffer 30 is snugly positioned at each of respective four bottom corners of the body 20 of packaging box.

Cutouts 24 formed on lids integrally connected to both top edges of opposed side walls for supporting the rear portion of article 10, are provided with support rods 26 bending at substantially right angle to back a portion of the rear side wall of buffer 30 and flaps 27 integrally formed with and extended from an free distal end of support rod 26.

The body 20 of packaging box of one preferred embodiment according to the present invention is provided with a chamber or hollow which is defined by four side walls 21, comprising a pair of opposed side walls are provided with a pair of lids integrally formed at its wall, which lids being perforated to accommodate buffers 30.

The other one, a pair of lid walls forming the upper layer of double-walled top of the body 20 when closed are provided with no cutouts therein.

Figure 5:
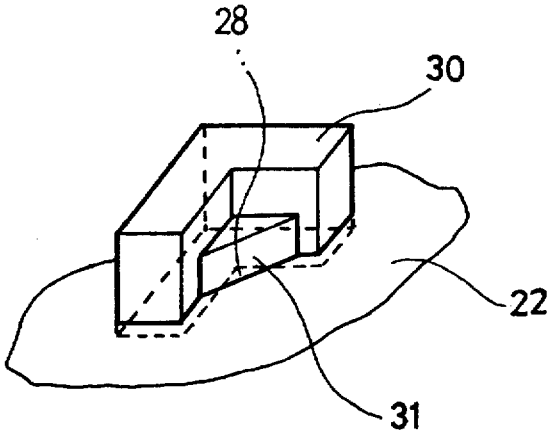
FIG. 5 is a perspective view of the reverse portion of the buffer illustrated in FIG. 4.
Figure 7:
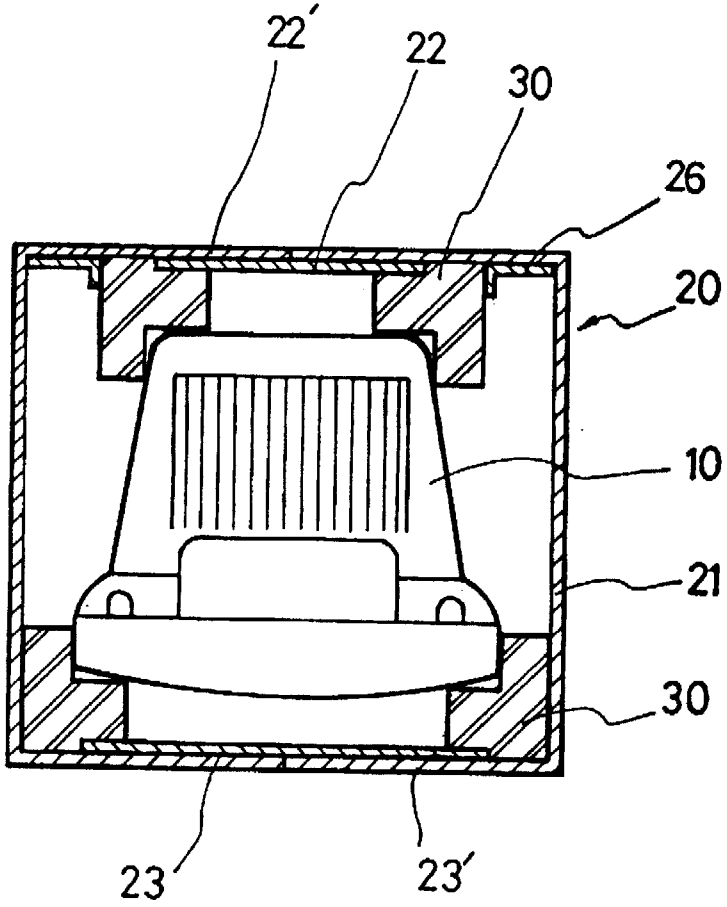
FIG. 7 is a side partially cross-sectional elevational view of an assembled packaging box constructed according to the principles of the present invention. illustrating an exemplar of encasing a video monitor.
Figure 6:
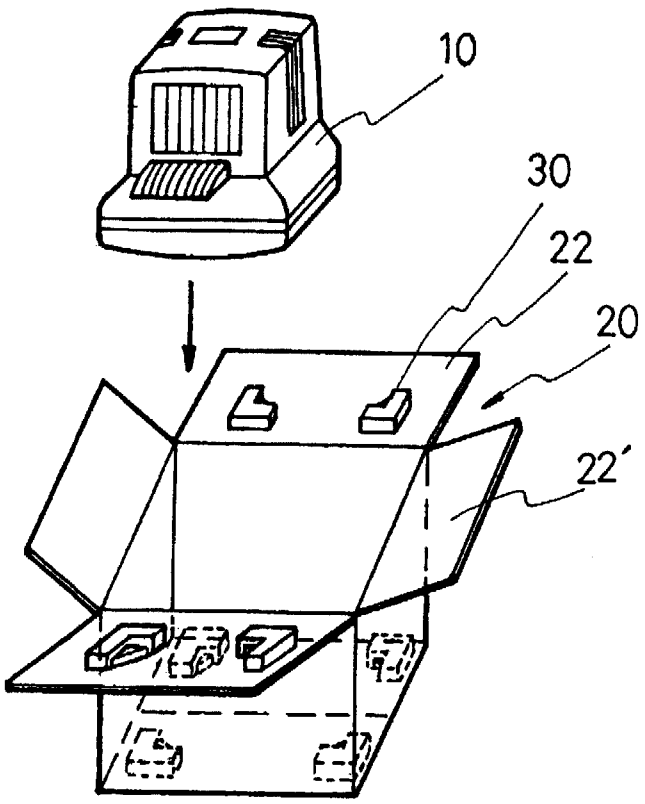
FIG. 6 is an exploded perspective view of a packing box according to the present invention, illustrating an exemplar of packing with a video monitor.

Referring now to FIG. 5, buffer 30 is provided with stiffener 31, in substantially trigonal prism, which being configured to accommodated and to matingly engage with corresponding corner of article 10, and also preventing the body of buffer from breaking outwardly away by operation of corner tabs 28 and 29.

Turning now to the assembly process for packing box for encasing an electronic for packing box for encasing an electronic and electrical product, such as, for example, a video monitor, of one embodiment of the present invention, buffer 30 is aligned with corresponding cutouts 24 and 25 and pushed to the outward direction from inside the body 20 until stiffener 31 get stuck to corner tabs 28 and 29.

When closed, a pair of lids having buffers 30 fit within cutouts 25 are folded to form the upper layer of double-walled bottom of body 20, and then the other couple of lids opposite each other, forming the lower layer, are bended to cover and back the upper layer.

Any conventional bonding agent such as, for example, adhesive tapes may be used for sealing the bottom surface of body 20.

The lower layer positioned below the upper layer supports and backs up the bottom surface of respective buffers 30, such that firm support to buffer 30 is secured by double-walled structure of the bottom wall of body 20.

Then, an article 10 is pulled down to base the four corners of front portion thereof on respective stiffener 31 formed upon buffer 30 so as that stabilized positioning can be obtained. Upon reception of article 10 in the chamber defined by four side walls of body 20, a pair of lids 22 provided with each of cutouts 24 are bended to cover top opening so that stiffener 31 of buffer 30 is able to support each corner of the rear portion of article 10 Thereafter, residual pair of lids are bended to overwrap and back up lids which serves as a cover, pressedly supporting the upper surface of respective buffer 30 thereby securing firm engagement between stiffener 31 and the individual corner. Support mat 40 is typically interposed between double-walled top and the rear surface of article 10. As usual, a conventionally adopted bonding agent such as adhesive tape may be applied, as necessary, to seal the top surface of packaging box.

Buffers 30 fastened to the upper layer consisted of a mate of lids 23 are so arranged to keep close adhesion of body 20 that when loaded, a stabilized support for a load be attained, Since the upper buffer 30 fastened in the upper lid 22 is assembled to a prearranged location according to the configuration of article 10, it is inoperative to separately support the upper buffer 30 spacedly apart from adjacent sidewall 21. Accordingly, support rod 26 protruding inwardly toward the opening of cutout 24 is forced to bend at substantially right angle to support both surfaces of outer portion of buffer 30. To reinforce adhesion of support rod 26, flap 27 integrally formed at a distal end of support rod 26 is again bent.

As describe above, a packaging box for encasing an electronic and electrical products of one preferred embodiment of the present invention brings substantial merits and advantages as will be explained in detail hereunder.

Buffer 30 is configured to only support a portion of each corners of both front and rear portion of an article 10, substantially in same size and dimensions, thereby markedly reducing unit costs, saving raw materials , enabling mass production and package automation during the manufacture and thus enhancing productivity, at a low cost.

Additionally, individual buffer 30 can be separated from body 20, enabling a recycling of materials and also eliminating such product liability issue as would arise by inadvertent manipulation of conventional type box-like container during conveyance or handling thereof.

More over, shrinked dimension of buffer 30 allows a storage in a limited space in a warehouse, thereby lessening relevant costs required for transportation and load.

While there have been illustrated and described what are considered to be embodiments of the present invention, it will be understood by those skilled in the art that various changes and modifications may be make, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments failing within the scope of the appended claims.

What is claimed is:

1. A packaging box made of a material having four side walls defining a hollow, a top pair of lids integrally formed at the top edges of opposing pairs of said side walls, a bottom pair of lids integrally formed at the bottom edges of opposing pairs of said side walls, a plurality of buffers being assembled on said lids for supporting in said hollow an article having four from corner portions and four rear corner portions, a plurality of bottom cutouts and a plurality of top cutouts, each of said top and bottom cutouts having a generally L-shaped configuration with a base and a leg extending from said base, said buffers being shaped substantially the same as said cutouts to be press-fittingly assembled and securely engaged within said cutouts, said bottom cutouts being formed in said bottom pair of lids, and being located adjacent to opposite ends of said bottom pairs of lids to position said buffers incorporated therein close to each lower corner of said hollow to thereby provide four supports for the four front corner portions of the article, said top cutouts being formed in said top pair of lids and being located to position said buffers incorporated therein to support the rear corner portions of the article, and support rods bent to conform to and support rear side walls of said buffers incorporated in said top cutouts, said support rods including integrally formed flaps extending from an edge of said support rods.

2. The packaging box of claim 1 wherein said buffers further include a stiffener for accommodating and mating with respective corner portions of the article.

* * * * *